United States Patent [19]

Larson

[11] Patent Number: 4,760,009

[45] Date of Patent: Jul. 26, 1988

[54] PROCESS FOR PREPARATION OF LIQUID TONER FOR ELECTROSTATIC IMAGING

[75] Inventor: James R. Larson, Greenville, Del.

[73] Assignee: E. I. Du Pont de Nemours and Company, Wilmington, Del.

[21] Appl. No.: 804,385

[22] Filed: Dec. 4, 1985

[51] Int. Cl.[4] ..... G03G 9/12

[52] U.S. Cl. ..... 430/137; 430/114

[58] Field of Search ..... 430/137, 110, 111, 119, 430/114; 524/563; 428/402

[56] References Cited

U.S. PATENT DOCUMENTS

| | | | |
|---|---|---|---|
| 3,234,017 | 2/1966 | Heyl et al. | 430/106 |
| 3,586,654 | 6/1971 | Lerman et al. | 260/41 |
| 4,157,974 | 6/1979 | Brechlin et al. | 252/62.1 L |
| 4,345,015 | 8/1982 | Hendriksma et al. | 430/137 |
| 4,363,863 | 12/1982 | Veillette et al. | 430/119 |
| 4,371,642 | 2/1983 | Jaffe | 524/563 |
| 4,478,925 | 10/1984 | Miskinis | 430/137 |

FOREIGN PATENT DOCUMENTS

| | | | |
|---|---|---|---|
| 47-14958 | 5/1972 | Japan | 430/106 |
| 58-2851 | 1/1983 | Japan | 430/106 |
| 2169416A | 7/1986 | United Kingdom . | |

OTHER PUBLICATIONS

Gruber Xerox Disclosure Journal, vol. 7, #4, Jul./Aug., 1982.

*Primary Examiner*—John L. Goodrow

[57] ABSTRACT

Process for preparation of toner particles for electrostatic imaging comprising (A) dispersing in a vessel at elevated temperature thermoplastic resin, nonpolar liquid and optionally a colorant, e.g., pigment, using moving particulate media, the temperature being sufficient to plasticize and liquify the resin and below the decomposition temperature of resin and/or colorant and below nonpolar liquid boiling point; (B) cooling the dispersion while maintaining continuous movement of the particulate media during and subsequent to cooling whereby toner particles are formed having an average by area particle size of less than 10 μm and a plurality of fibers; and (C) separating the dispersion having a concentration of toner particles from the particulate media. After step (C) the dispersion can be diluted with additional nonpolar solvent and/or a charge director can be added. The dispersion having a concentration of toner particles is useful for the preparation of copies and proofs of various colors.

25 Claims, No Drawings

PROCESS FOR PREPARATION OF LIQUID TONER FOR ELECTROSTATIC IMAGING

DESCRIPTION

1. Technical Field

This invention relates to an improved process for the preparation of toner particles. More particularly this invention relates to a process for the preparation of toner particles having a plurality of fibers in a liquid medium for electrostatic imaging.

2. Background Art

It is known to develop a latent electrostatic image with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said nonpolar liquid and the image may subsequently be transferred to a carrier sheet.

There are many methods of making liquid toners. Improved toner particles having a plurality of fibers have been recently developed. These toner particles due to the fibers which extend therefrom may intertwine or interlink physically in an image developed with a developing liquid through which has been dispersed the toner particles. This results in images having superior sharpness, line acuity and a high degree of resolution. In addition, the developed image may be transferred to a carrier sheet with substantially little squash and thicker denser images having good sharpness may be built up.

In one method of preparation of the improved toner particles having a plurality of fibers are prepared by dissolving one or more polymers in a nonpolar dispersant, together with particles of a pigment, e.g., carbon black. The solution is cooled slowly, while stirring, whereby precipitation of particles occurs. The precipitated particles have fibers extending therefrom. Applicant has found that by repeating the above process, as indicated in Control 1 below, a large percentage of the resultant toner particles were larger than the desired less than 10 μm average by area size, and material was observed that was greater than 1 mm in size. As noted in Control 2 below, by increasing the ratio of solids to nonpolar liquid the toner particles can be controlled within the desired size range, but it has been found that the density of images produced may be relatively low and when a transfer is made to a carrier sheet, for example, the amount of image transferred thereto may be relatively low.

In another method of preparation of toner particles having a plurality of fibers, the plasticizing of the thermoplastic polymer and pigment with a nonpolar liquid forms a gel or solid mass which is shredded into pieces, more nonpolar liquid is added, the pieces are wet-ground into particles, and grinding is continued which is believed to pull the particles apart to form fibers extending therefrom. While this process is useful in preparing the improved toners, it requires long cycle times and excessive material handling, i.e., several pieces of equipment are used.

It has been found that the above disadvantages can be overcome and toner particles prepared without the formation of a gel or solid mass by a process that does not require excessive handling whereby toner particles having an average size (by area) below 10 μm are dispersed and formed in the same vessel. When an image of such dispersed toner particles is transferred to a carrier sheet a substantial amount of the image transfers providing a suitably dense copy or reproduction.

DISCLOSURE OF THE INVENTION

In accordance with this invention there is provided a process for the preparation of toner particles for electrostatic imaging comprising A. dispersing at an elevated temperature in a vessel a thermoplastic resin, a nonpolar liquid having a Kauributanol value of less than 30, and optionally a colorant by means of moving particulate media whereby the moving particulate media creates shear and/or impact, while maintaining the temperature in the vessel at a temperature sufficient to plasticize and liquify the resin and below that at which the nonpolar liquid boils and the resin and/or colorant decomposes, B. cooling the dispersion to permit precipitation of the resin out of the dispersant, the particulate media being maintained in continuous movement during and subsequent to cooling whereby toner particles having an average by area particle size of less than 10 μm and a plurality of fibers are formed, and C. separating the dispersion of toner particles from the particulate media.

The process of this invention results in toner particles adapted for electrophoretic movement through a nonpolar liquid formed with a plurality of fibers. The term "fibers" as used herein means pigmented toner particles formed with fibers, tendrils, tentacles, threadlets, fibrils, ligaments, hairs, bristles, or the like.

The toner particles are prepared from at least one thermoplastic polymer or resin, suitable colorants and nonpolar dispersant liquids as described in more detail below. Additional components can be added, e.g., charge director, polyethylene, fine particle size oxides such as silica, etc.

Useful thermoplastic resins or polymers which are able to form fibers include: ethylene vinyl acetate (EVA) copolymers (Elvax® resins, E. I. du Pont de Nemours and Company, Wilmington, DE), copolymers of ethylene and an α,β-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, isotactic polypropylene (crystalline), ethylene ethyl acrylate series sold under the trademark Bakelite® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, DE, etc. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. It is believed that the preferred copolymers have greater thermal stability and higher strength properties due to two factors: the presence of an alkyl group on the same carbon atom on the polymer chain to which is attached a carboxylic acid group as well as hydrogen bonding, brought about by intermolecular and intramolecular dimerization. Both factors increase the chain stiffness and the energy required for rotation of the polymer chain. Particularly preferred copolymers of this type have an acid number of 66 and 60 and a melt index of 100 and 500 determined at 190° C., respectively.

In addition to being thermoplastic and being able to form fibers, the resins have the following characteristics:

1. Be able to disperse the colorant, e.g., pigment,
2. Be insoluble in the dispersant liquid at temperatures below 40° C., so that it will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, CA using a centrifugal rotation of 1,000 rpm, a particle size range of 0.01 to 10 μm, and a particle size cut of 1.0 μm.
6. Be able to fuse at temperatures in excess of 70° C.

By solvation in 3. above, the resins forming the toner particles will become swollen or gelatinous. This indicates the formation of complexes by the combination of the molecules of the resin with the molecules of the dispersant liquid.

Colorants, such as pigments or dyes and combinations thereof, are normally present to render the latent image visible, though this need not be done in some applications. The colorant, e.g., a pigment, may be present in the amount of up to 60 percent by weight based on the weight of the resin. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Stirling NS N 774 (Pigment Black 7, C.I. No. 77266).

If desired, a finely ground ferromagnetic material may be used as a pigment. Other suitable materials such as metals including iron, cobalt, nickel, various metal oxides including: aluminum oxide, ferric oxide, cupric oxide, nickel oxide, zinc oxide, zirconium oxide, titanium oxide, and magnesium oxide; certain ferrites such as zinc, cadmium, barium, manganese; chromium dioxide; various of the permalloys and other metal alloys or metal compositions comprising, e.g., cobalt-phosphorus, cobalt-nickel, aluminum, cobalt, copper, iron, lead, magnesium, nickel, tin, zinc, gold, silver, antimony, beryllium, bismuth, cadmium, calcium, magnanese, titanium, vanadium, and/or zirconium; refractory metal nitrides, e.g., chromium nitride; metal carbides, e.g., tungsten carbide, silica carbide; and mixtures of any of these may be used. Fine particle size oxides, e.g., silica, alumina, titania, etc.; preferably in the order of 0.5 μm or less can be dispersed into the liquified resin. These oxides can be used alone or in combination with the colorants.

The nonpolar dispersant liquids are, preferably, branched-chain aliphatic hydrocarbons and more particularly, Isopar®-G, Isopar®-H, Isopar®-K, Isopar®-L, and Isopar®-M. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| Norpar® 15 | 118 | 210 |

All of the dispersant liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant liquids, the essential characteristics of all suitable dispersant liquids are the electrical volume resistivity and the dielectric constant. In addition, a feature of the dispersant liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

Into a suitable vessel, e.g., attritor, heated ball mill, heated vibratory mill such as a Sweco Mill Mfg. by Sweco Co., Los Angeles, CA, equipped with particulate media for dispersing and grinding are placed the above-described ingredients. Generally all are placed in the vessel prior to start of the dispersing step although after homogenizing the resin and the dispersant nonpolar liquid the colorant can be added. The dispersing step is generally accomplished at elevated temperature, i.e., the temperature of ingredients in the vessel being sufficient to plasticize and liquify the resin but being below that at which the nonpolar liquid boils and the resin and/or colorant decomposes. A preferred temperature range is 80° to 120° C. Other temperatures outside this range may be suitable, however, depending on the particular ingredients used. The presence of the irregularly moving particulate media in the vessel surprisingly is essential to prepare the dispersion of toner particles. It has been found that stirring the ingredients, even at a high rate, is not sufficient to prepare dispersed toner particles of proper size, configuration and morphology, particularly as noted in Control 1 below. Useful particulate media are particulate materials, e.g., spherical, cylindrical, etc. taken from the class consisting of steel, e.g., stainless or carbon; alumina, ceramic, zirconium, silica, and sillimanite. When a colorant, e.g., yellow, cyan or magenta, is present carbon steel is preferred as the particulate media. A typical diameter range for the particulate media is in the range of 0.04 to 0.5 inch (1.0 to ~13 mm).

After dispersing the ingredients in the vessel with the particulate media for a period of about 0.5 to 2 hours with the mixture being fluid, the dispersion is cooled, e.g., 0° C. to 50° C. by circulating cold water or a cooling material through an external cooling jacket as is known to those skilled in the art, to permit precipitation of the resin out of the dispersant. It is important that the particulate media be maintained in continuous movement, creating shear and/or impact, during and subsequent to cooling, whereby toner particles of the desired average (by area) particle size, e.g., less than 10 μm, having a plurality of fibers are formed. After cooling and separating from the particulate media, it is possible to reduce the concentration of the toner particles in the dispersion, impart an electrostatic charge of predetermined polarity to the toner particles, or a combination of these variations.

The concentration of the toner particles in the dispersion is reduced by the addition of additional nonpolar liquid as described previously above. The dilution is conducted to reduce the concentration of toner particles to between 0.1 to 3 percent by weight, preferably 0.5 to 2 weight percent with respect to the nonpolar liquid. The toner particles resulting have an average (by area) particle size of 0.1 to less than 10 μm, e.g., as determined by a Horiba CAPA-500 centrifugal particle analyzer described above or other comparable apparatus.

One or more charge directors as known to those skilled in the art can be added to impart a positive or negative charge as desired. The charge director may be added at any time during the process. If a diluting nonpolar liquid is also added, the charge director can be added prior to, concurrently with or subsequent thereto. Generally 1 to 100 mg/g toner solids of the charge director is required. Suitable positive charge directors are sodium dioctylsulfosuccinate (manufactured by American Cyanimid Co.), zirconium octoate and metal soaps such as copper oleate, etc. Suitable negative charge directors are lecithin, barium petronate, calcium petronate (Witco Chemical Corp., New York, NY), alkyl succinimide (manufactured by Cheveron Chemical Company of California), composition trademarked OLOA and sold by the Oronite Division of the California Chemical Company, etc. The conductivity which has proven particularly useful is in the range of about 5 to 100 pmho/cm. The dispersion having a concentration of toner particles is separated from the particulate media by means known to those skilled in the art. A preferred mode of the invention is described in Examples 1 and 2.

INDUSTRIAL APPLICABILITY

The improved process of this invention results in dispersed toner particles having a plurality of fibers. By the process defined such toner particles having a controlled particle size range can be prepared more quickly with less material handling and equipment than certain other methods of preparation. The toner is of the liquid type and is particularly useful in copying, e.g., making office copies of black and white as well as various colors; or color proofing, e.g., a reproduction of an image using the standard colors: yellow, cyan and magenta together with black as desired. In copying and proofing the toner particles are applied to a latent electrostatic image. The toner particles due to the fibers extending therefrom may interdigitate, intertwine, or interlink physically in an image developed with a developing liquid through which has been dispersed the toner particles. The result is an image having superior sharpness, line acuity, i.e., edge acuity, and a high degree of resolution. The salient feature of the developed image is that it has good compressive strength, so that it may be transferred from the surface on which it is developed to a carrier sheet without squash. Because of the intertwining of the toner particles, a thicker, denser image may be built up and good sharpness still obtained. The thickness can be controlled by varying the charge potential on the photoconductor, by varying the development time, by varying the toner-particle concentration, by varying the conductivity of the toner particles, by varying the charge characteristics of the toner particles, by varying the particle size, or by varying the surface chemistry of the particles. Any or a combination of these methods may be used. The image is capable of being transferred to a carrier sheet or receptive support such as papers of the type described in the examples below, flexible films, e.g., polyethylene terephthalate; cardboard, rubber, etc.

Other uses are envisioned for the improved toner particles, e.g., the formation of copies or images using toner particles containing finely divided ferromagnetic materials or metal powders; conductive lines using toners containing conductive materials, resistors, capacitors and other electronic components; lithographic printing plates, etc.

EXAMPLES

The following examples wherein the parts and percentages are by weight illustrate but do not limit the invention. In the examples lp/mm means line pairs/mm, the melt indices were determined by ASTM D 1238, Procedure A, and the average particle sizes by area were determined by a Horiba CAPA-500 centrifugal particle analyzer as described above.

EXAMPLE 1

In a Union Process 1-S Attritor, Union Process Company, Akron, Ohio was placed the following ingredients in the amounts indicated:

| Ingredient | Amount (g) |
|---|---|
| Copolymer of ethylene (89%) and methacrylic acid (11%), melt index at 190° C. is 100, Acid No. is 66 | 200.0 |
| Mogul ® L carbon black C.I. No. 77266, Cabot Corp., Cabon Black Division, Boston, MA | 66.0 |
| Isopar ®-L, nonpolar liquid having Kauri-butanol value of 27, Exxon Corporation | 1000.0 |

The ingredients were heated to 100° C.±10° C. and milled at a rotor speed of 230 rpm with 0.1875 inch (4.76 mm) diameter stainless steel balls for one hour. The attritor was cooled to 42° C.±5° C. with cooling water while the milling was continued and then 700 g of Isopar ®-H nonpolar liquid having a Kauri-butanol value of 27, Exxon Corporation was added. Milling was continued at a rotor speed of 330 rpm for three hours whereby a dispersion of toner particles having an average particle size (by area) of about 1.6 μm was obtained with 95% of the particles being less than 7 μm. After removal of the particulate media, the dispersion was diluted with additional Isopar ®-H to provide 2% solids; 25 g of a 2.5% solution of lecithin in Isopar ®-H was then added giving the dispersion a conductivity of 15 pmho/cm. Image quality was determined using a Savin 870 copier at standard mode; charging corona set at 6.8 kv and transfer corona set at 8.0 kv using the indicated carrier sheet as shown in Table 1.

TABLE 1

| Carrier Sheet | Density | Resolution (lp/mm) |
|---|---|---|
| Savin 2200 paper Savin Corp., Binghamton, NY | 1.4 | 9.0 |
| Plainwell off-set enamel paper #3 gloss 60 lb test, Plainwell Paper Co., Plainwell, Michigan | 2.5 | 9.0[1] |

[1]89% of the image was transferred to the carrier

The conductivity of the dispersion was increased to 67 phmo/cm by the addition of an additional 25 g of the 2.5% lecithin solution. The density for the Plainwell off-set enamel paper after the conductivity was increased was 2.4 with a resolution of 11 lp/mm, 94% of the image was transferred to the carrier.

EXAMPLE 2

Example 1 is repeated except that the attritor was cooled to 25° C.±5° C. with cold water. The milling in the attritor was conducted for six hours whereby a dispersion of toner particles having an average particle size by area of about 1.5 μm was obtained. The toner particles obtained were equivalent to those obtained in Example 1.

EXAMPLE 3

The procedure described in Example 2 was followed to produce dispersions of toner particles as shown in Table 2. Where image quality is shown it was determined by the procedure described in Example 1.

TABLE 2

| Sample | Resin (g) | Pigment/Additive (g) | Nonpolar Liquid (g) ISOPAR ®-L | Nonpolar Liquid (g) ISOPAR ®-H |
|---|---|---|---|---|
| 1. | Copolymer Ex. 1 (25)[1] | 345 BASF Magnetic Pigment (25) | 100 | 133 |
| 2. | Copolymer Ex. 1 (25)[2] | Day Ferrox ® 8600 (25) $Fe_3O_4$, 0.2 μm | 125 | 150 |
| 3. | Copolymer Ex. 1 (25)[3] | Pfizer MO-2230 (15) iron oxide pigment | 125 | 130 |
| 4. | Copolymer of ethylene (80%)/ methacrylic acid (10%)/ Butyl ester of methacrylic acid (10%) melt index[7] at 190° C. is 10, Acid No. is 60 (200)[4] | Mogul ® L Carbon Black (27) | 1000 | 700 |
| 5. | Sample 4 above with melt index at 190° C. of 35 (200)[5] | Mogul ® L Carbon Black (67) | 1000 | 700 |
| 6. | Polyethylene, density is 0.923, melt index at 190° C. is 4.5 (25)[6] | Day Ferrox ® 8600 (15) (see Sample 2 above) | 125 | 140 |
| 7. | Copolymer of | Pfizer MO-2230 | 125 | 140 |

TABLE 2-continued

| Sample | Resin (g) | Pigment/Additive (g) | Nonpolar Liquid (g) ISOPAR ®-L | ISOPAR ®-H |
|---|---|---|---|---|
| | Ethylene (85%) and methacrylic acid (15%), melt index at 190° C. is 25 (25)[7] | (15) (see Sample 3 above) | | |
| 8. | Copolymer of of Ex. 1 (200)[8] | Du Pont BT-383 D cyan pigment(26.7)/ Cab-O-Sil ® EH-5 silica, Cabot Corp. (40) | 1000 | 700 |
| 9. | Copolymer of Ex. 1 (200)[9] | Mobay RV-6803 (20) Mobay R-6300 (6.7) magenta pigments/ Cab-O-Sil ® EH-5 silica, Cabot Corp. (40) | 1000 | 700 |
| 10. | Copolymer of Ex. 1 (25)[10] | Heubach YT-858D yellow pigment/(3.3) Cab-O-Sil ® EH-5 silica, Cabot Corp. (5) | 125 | 88 |

Footnotes:
[1]Union Process 01 Attritor was used; 88 hour grind cycle resulted in toner particles with an average size of 1.8 μm.
[2]Union Process 01 Attritor was used; 70 hour grind cycle resulted in toner particles with an average size of 1.7 μm.
[3]Union Process 01 Attritor was used; 45 hour grind cycle resulted in toner particles with an average size of 2.1 μm.
[4]Union Process 1-S Attritor was used; 62 hour grind cycle resulted in toner particles with an average size of 0.8 μm. Image quality: density of 1.4 for Savin 2200 paper with a resolution of 7 lp/mm; density of 2.6 for Plainwell off-set enamel with a resolution of 9 lp/mm.
[5]Union Process 1-S Attritor was used; 26 hour grind cycle resulted in toner particles with an average size of 1.0 μ. Image quality: density of 1.4 for Savin 2200 paper with a resolution of 8 lp/mm; density of 2.4 for Plainwell off-set enamelwith a resolution of 8 lp/mm.
[6]Union Process 01 was used; 40 hour grind cycle resulted in toner particles with an average size of 2.7 μm.
[7]Union Process 01 Attritor was used; 47 hour grind cycle resulted in toner particles with an average size of 2.8 μm.
[8]Union Process 1-S Attritor was used; 69 hour grind cycle resulted in toner particles with an average size of 1.2 μm. Image quality: density of 1.5 for Savin 2200 paper with a resolution of 6 lp/mm; density 1.6 for Plainwell off-set enamel with a resolution of 6 lp/mm.
[9]Union Process 1-S Attritor was used; 74 hour cycle resulted in toner particles with an average size of 1.4 microns. Image quality: density of 1.0 for Savin 2200 paper with a resolution of 9 lp/mm; density of 1.5 for Plainwell off-set enamel with a resolution of 9 lp/mm.
[10]Union Process 01 Attritor was used; 22 hour cycles resulted in toner particles with an average size of 1.6 μm. Image quality; density of 1.3 for Savin 200 paper with a resolution of 6 lp/mm; density of 1.8 for Plainwell off-set enamel with a resolution of 9 lp/mm.

CONTROL 1

In a Ross double planetary jacketed mixer Model No. LDM, Charles Ross & Son Company, Hauppauge, N.Y. (no particulate media were present) was placed the same ingredients in the same amounts as set out in Example 1. The ingredients were heated to 90° C.±10° C. and stirred at the maximum rate for two hours. The mixture was cooled to 25° C.±5° C. with cold water while continuously stirring the ingredients and adding 700 g of Isopar ®-H. The dispersion of toner particles obtained was not satisfactory since 42.8% of the material had an average particle size (by area) greater than 10 μm and material was observed that was greater than 1 mm in size.

CONTROL 2

In the Ross double planetary mixer described in Control 1 was placed the following ingredients in the amounts indicated:

| Ingredient | Amount (g) |
|---|---|
| Copolymer described in Ex. 1 | 500.0 |
| Carbon black described in Ex. 1 | 166.0 |

-continued

| Ingredient | Amount (g) |
|---|---|
| Isopar ®-L | 250.0 |

The ingredients were heated to 90° C.±10° C. and stirred at the maximum rate for 30 minutes. 1750 g of Isopar ®-L was slowly added to the ingredients over a two hour period while maintaining the temperature at 90° C.±10° C. Upon completion of the addition of Isopar ®-L, the mixture was cooled to room temperature with continued stirring at the maximum rate. The dispersion of toner particles produced had an average particle size of 1.5 μm. The dispersion of toner particles was diluted and charged as described in Example 1 and the image quality also was determined as described in Example 1. The density of an image on Plainwell off-set enamel paper was 0.6 with a resolution of 9 lp/mm. Less than 50% of the image was transferred. The toner particles produced are not considered to be satisfactory in quality even though the average particle size is within the desired range.

EXAMPLE 4

Using a Union Process 01 Attritor, toner particles were prepared as described in Example 2 (milling time: 87 hours) with the following ingredients in the amounts indicated:

| Ingredient | Amount (g) |
|---|---|
| Copolymer of ethylene (95)/ methacrylic acid (5), melt index at 190° C. is 50 | 25.0 |
| Pfizer MO-2230 iron oxide pigment | 15.0 |
| Isopar ®-L | 125.0 |
| Isopar ®-H | 130.0 |

The dispersion of toner particles, 1.87 μm average particle size (by area), was diluted with Isopar ®-H to a 2% solids dispersion which was further diluted in a 1 to 1 ratio with Isopar ®-H containing 10% barium petronate, 50% solution, Witco Chemical Co., New York, NY. An imaged magnetic element comprising a support with a $CrO_2$ layer was toned with the dispersion and 0.5% dots and 8.0 μm lines were resolved.

We claim:

1. A process for the preparation of toner particles for electrostatic liquid developers comprising A. dispersing at an elevated temperature in a vessel a thermoplastic resin and, a nonpolar liquid having a Kauri-butanol value of less than 30, by means of moving particulate media whereby the moving particulate media creates shear and/or impact, while maintaining the temperature in the vessel at a temperature sufficient to plasticize and liquify the resin and below that at which the nonpolar liquid boils and the resin decomposes, B. cooling the dispersion in said vessel to permit precipitation of the resin out of the dispersant, the particulate media being maintained in continuous movement during and subsequent to cooling whereby toner particles having an average by area particle size of less than 10 μm and a plurality of fibers extending therefrom are formed, and C. separating the dispersion of toner particles from the particulate media.

2. A process according to claim 1 wherein the particulate media are taken from the class consisting of stainless steel, ceramic, alumina, zirconium, silica, and sillimanite.

3. A process according to claim 2 wherein the particulate media are spherical having an average diameter of 0.04 to 0.5 inch.

4. A process according to claim 1 wherein the thermoplastic resin is an ethylene vinyl acetate copolymer.

5. A process according to claim 1 wherein a colorant is present comprising carbon black.

6. A process according to claim 1 wherein a colorant is present comprising a colored material.

7. A process according to claim 1 wherein a colorant is present which is a pigment comprising finely divided ferromagnetic material.

8. A process according to claim 1 wherein a colorant is present which is a metal powder.

9. A process according to claim 1 wherein a fine particle size oxide is present.

10. A process according to claim 12 wherein the oxide is silica.

11. A process according to claim 1 wherein a colorant and a fine particle size oxide are present.

12. A process according to claim 1 wherein a combination of colorants is present.

13. A process according to claim 1 wherein after step C a charge director is added to the dispersion to impart an electrostatic charge of predetermined polarity to the toner particles.

14. A process according to claim 13 wherein the thermoplastic resin is a copolymer of ethylene (89%) and methacrylic acid (11%) having a melt index at 190° C. of 100.

15. A process according to claim 1 wherein a plurality of thermoplastic resins are employed in the plasticizing step A.

16. A process according to claim 1 wherein subsequent to step C diluting the dispersion with additional nonpolar liquid.

17. A process according to claim 16 wherein the thermoplastic resin is a copolymer of ethylene (89%) and methacrylic acid (11%) having a melt index at 190° C. of 100.

18. A process according to claim 16 wherein the dilution is conducted to reduce the concentration of toner particles to between 0.1 to 3.0 percent by weight with respect to the nonpolar liquid.

19. A process according to claim 1 wherein the toner particles have an average by area particle size of less than 5 μm.

20. A process according to claim 1 wherein a colorant is present in step A and the temperature is maintained in the vessel below that at which the nonpolar liquid boils and the resin and colorant decomposes.

21. A process for the preparation of toner particles for electrostatic liquid developer comprising A. dispersing at an elevated temperature in a vessel a thermoplastic resin which is a copolymer of ethylene and an α-β-ethylenically unsaturated acid selected from the class consisting of acrylic acid and methacrylic acid and., a nonpolar liquid having a Kauri-butanol value of less than 30, by means of moving particulate media whereby the moving particulate media creates shear and/or impact, while maintaining the temperature in the vessel at a temperature sufficient to plasticize and liquify the resin and below that at which the nonpolar liquid boils and the resin decomposes, B. cooling the dispersion in said vessel to permit precipitation of the resin out of the dispersant, the particulate media being maintained in continuous movement during and subsequent to cooling whereby toner particles having an average by area particle size of less than 10 μm and a plurality of fibers extending therefrom are formed, and C. separating the dispersion of toner particles from the particulate media.

22. A process for the preparation of toner particles for electrostatic liquid developers comprising A. dispersing at an elevated temperature in a vessel a thermoplastic resin which is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%), and a nonpolar liquid having a Kauri-butanol value of less than 30, by means of moving particulate media whereby the moving particulate media creates shear and/or impact, while maintaining the temperature in the vessel at a temperature sufficient to plasticize and liquify the resin and below that at which the nonpolar liquid boils and the resin decomposes, B. cooling the dispersion in said vessel to permit precipitation of the resin out of the dispersant, the particulate media being maintained in continuous movement during and subsequent to cooling whereby toner particles having an average by area particle size of less than 10 μm and a plurality of fibers extending therefrom are formed, and C. separating the dispersion of toner particles from the particulate media.

23. A process according to claim 21 wherein the thermoplastic resin is a copolymer of ethylene (89%)/methacrylic acid (11%) having a melt index at 190° C. of 100.

24. A process according to claim 21 wherein a colorant is present in step A and the temperature is maintained in the vessel below that at which the nonpolar liquid boils and the resin and colorant decomposes.

25. A process according to claim 22 wherein a colorant is present in step A and the temperature is maintained in the vessel below that at which the nonpolar liquid boils and the resin and colorant decomposes.

* * * * *

UNITED STATES PATENT AND TRADEMARK OFFICE

CERTIFICATE OF CORRECTION

PATENT NO. : 4,760,009

DATED : July 26, 1988

INVENTOR(S) : James Rodney Larson

It is certified that error appears in the above-identified patent and that said Letters Patent is hereby corrected as shown below:

Column 11, line 56, after "claim", "1" should be --20--.

Column 11, line 58, after "claim", "1" should be --20--.

Column 11, line 63, after "claim", "1" should be --20--.

Column 11, line 67, after "claim", "12" should be --9--.

Column 12, line 1, after "claim", "1" should be --20--.

Column 12, line 3, after "claim", "1" should be --20--.

Signed and Sealed this

Thirty-first Day of January, 1989

*Attest:*

DONALD J. QUIGG

*Attesting Officer*

*Commissioner of Patents and Trademarks*